US005371489A

United States Patent [19]

Carroll et al.

[11] Patent Number: 5,371,489

[45] Date of Patent: Dec. 6, 1994

[54] MOTION SENSING AND LIGHT FLASHING APPARATUS

[76] Inventors: Lee J. Carroll, 5312 Gillespie St., Philadelphia, Pa. 19124; Diana D. Harahan, 4460 Livingston St., Philadelphia, Pa. 19137

[21] Appl. No.: 892,260

[22] Filed: Jun. 2, 1992

[51] Int. Cl.[5] ..... G08B 13/00

[52] U.S. Cl. ..... 340/565; 315/159; 340/326; 340/331; 340/332; 340/691

[58] Field of Search ..... 340/565, 567, 573, 691, 340/331-332, 815.1, 326, 426; 367/93; 250/221, 342; 315/155, 133, 159; 342/28; 358/108; 362/802, 811, 253; 348/143, 152, 155

[56] References Cited

U.S. PATENT DOCUMENTS

| | | | |
|---|---|---|---|
| 4,064,508 | 12/1977 | Simon | 340/691 X |
| 4,074,252 | 2/1978 | Keller | 340/331 X |
| 4,386,342 | 5/1983 | McKinley | 340/544 |
| 4,551,654 | 11/1985 | Barnum | 315/159 |
| 4,651,144 | 3/1987 | Pagano | 340/693 |
| 4,694,281 | 9/1987 | McDermott et al. | 340/691 X |
| 4,864,278 | 9/1989 | Wiley | 250/221 X |
| 4,942,384 | 7/1990 | Yamauchi et al. | 340/522 |
| 4,951,045 | 8/1990 | Knapp et al. | 340/691 X |
| 4,970,436 | 11/1990 | Sacchetti | 315/159 |
| 4,992,701 | 2/1991 | Sacchetti | 315/159 |

*Primary Examiner*—John K. Peng
*Assistant Examiner*—Thomas J. Mullen, Jr.
*Attorney, Agent, or Firm*—John R. Flanagan

[57] ABSTRACT

An alerting apparatus includes a pair of separate first and second lights capable of providing respective illuminations that are different from one another, an electrical power supply cord connected to the first and second lights for providing a supply of electrical power to activate the lights, and a motion detector connected to the electrical power supply cord and the first and second lights for activating the first and second lights for predetermined times in response to sensing motion in a predetermined area. The first light can provide a constant white illumination, while the second light can provide a flashing red illumination. Also, an alarm can be connected to the motion detector and the electrical power supply.

8 Claims, 2 Drawing Sheets

MOTION SENSING AND LIGHT FLASHING APPARATUS

BACKGROUND OF THE INVENTION

1. Field of the Invention

The present invention generally relates to motion sensing and lighting systems and, more particularly, is concerned with a motion sensing and light flashing apparatus.

2. Description of the Prior Art

Security lighting systems are widely used for prevention of crime and vandalism in many communities. These security systems are commonly used to monitor residential and business properties, such as the areas encompassing entrances to buildings, during nighttime hours. Representative examples of these security lighting systems in the prior art are the ones disclosed in U.S. Pat. Nos. to Barnum (4,551,654), Yamauchi et al (4,942,384) and Sacchetti (4,970,436 and 4,992,701).

One conventional security lighting system employs a lamp capable of illuminating a given protected area and a motion detector capable of turning on the lamp. The motion detector typically utilizes either ultrasound, infrared or some other suitable form of energy. The motion detector senses and is activated by the motion of an intruder or other individual entering into the given protected area which is being monitored by the sensor. Activation of the motion detector, in turn, turns on the lamp to illuminate the protected area for a given period of time.

This conventional security lighting system provides the type of illumination that will reveal or expose the presence of the intruder. The system may also set off an alarm or buzzer in a residence or building adjacent to the protected area that will alert the user of the system of the possible presence of the intruder. However, one important drawback of the system is that it fails to provide the type of illumination that will necessarily ensure its notice by others in the vicinity, such as neighbors or a passing police car, who would be apt to investigate.

Consequently, a need still remains for improvement in the design of a security lighting system in order to overcome the above-mentioned drawback.

SUMMARY OF THE INVENTION

The present invention provides a motion sensing and light flashing apparatus designed to overcome existing problems and satisfy the aforementioned need. The motion sensing and light flashing apparatus of the present invention employs separate lamps which provide different illumination. Preferably, one illumination, such as white in color, remains lit constantly for a predetermined time. The other illumination, such as red in color, flashes on and off for a predetermined time. The flashing red illumination will function not only to assist in scaring off the intruder, but to alert anyone seeing the flashing red light to investigate or to call the police.

Accordingly, the present invention is directed to a motion sensing and light flashing apparatus which comprises: (a) means for providing separate respective first and second illuminations being different from one another; (b) means for providing a supply of electrical power to activate the lights; (c) a motion detector capable of sensing motion in a predetermined area; and (d) means for electrically interconnecting the electrical power supply providing means, the motion detector, and the first and second lights to activate the first and second lights for predetermined times in response to the motion detector sensing motion in the predetermined area.

Preferably, the illuminations providing means is a pair of first and second lamps. The first lamp provides a constant illumination, whereas the second lamp provides a flashing illumination. Also, the illumination provided by the first lamp is of a first color, such as white, whereas the illumination provided by the second lamp is of a second different color, such as red. Each illumination stays on as long as detection of the motion continues or for a predetermined time thereafter, and then automatically turns off.

Further, electrically interconnecting means is a circuit arrangement of electrical conductors. The circuit arrangement connects the first and second lamps in electrical parallel relation with one another and connects the motion detector in electrical series relation with the electrical power supply providing means and the first and second lamps. The apparatus also includes an electrical switch actuatable between on and off positions. The circuit arrangement connects the electrical switch in electrical series relation with the motion detector and the electrical power supply providing means. Preferably, the electrical power supply providing means is an electrical cord having an outlet plug at one end.

Also, the apparatus includes a signaling device, and means for electrically coupling the signaling device to the interconnecting means so as to activate the signaling device when the first and second lamps are activated by the motion detector. The signaling device is an audible alarm and the coupling means is an electrical transformer. Additionally, an electrical on/off switch is connected in electrical series relation with the transformer and the signaling device.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, reference will be made to the attached drawings in which.

DETAILED DESCRIPTION OF THE INVENTION

Figure 1:
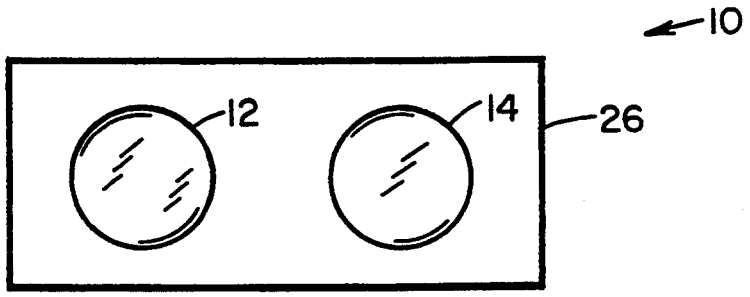
FIG. 1 is a front elevational view of a motion sensing and light flashing apparatus of the present invention.
Figure 2:
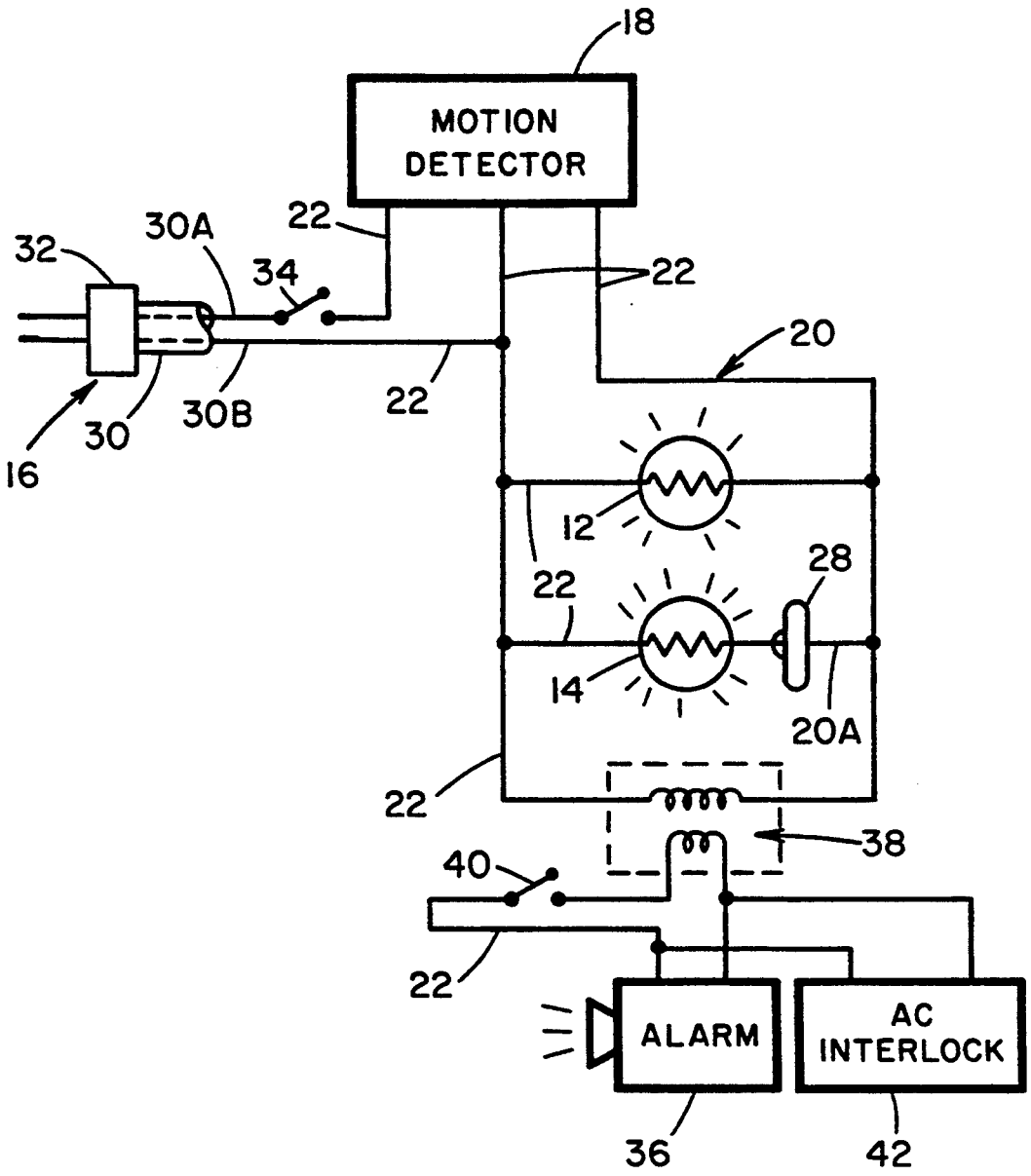
FIG. 2 is a electrical schematic diagram of the motion and light flashing apparatus of FIG. 1.

Referring to the drawings and particularly to FIGS. 1 and 2, there is illustrated a motion sensing and light flashing apparatus, generally designated 10, of the present invention. The apparatus 10 functions to provide a constant illumination that will reveal or expose the presence of an intruder and a flashing illumination that will be noticed by others in the vicinity prompting an investigation or call to the police.

Basically, the motion sensing and light flashing apparatus 10 includes a pair of separate first and second lights 12, 14, means 16 for providing a supply of electrical power, a motion detector 18, and a circuit arrangement 20 of electrical conductors 22. The electrical conductors 22 of the circuit arrangement 20 electrically interconnect the electrical power supply providing means 16, the motion detector 18, and the first and second lights 12, 14 so as to cause activating of the first and second lights 12, 14 for a predetermined time in response to the motion detector 18 sensing motion in a predetermined area monitored by the motion detector 18.

Figure 3:
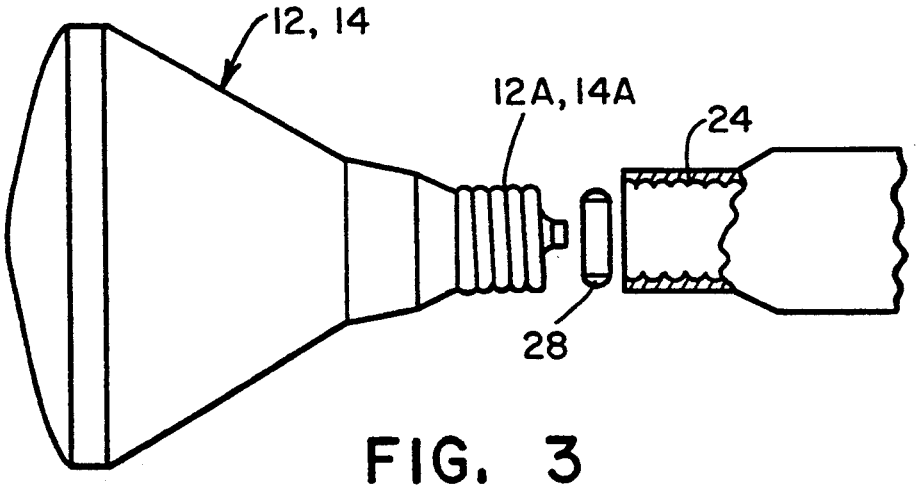
FIG. 3 is a fragmentary exploded view of one lamp and lamp holder socket of the apparatus of FIG. 1.

Referring to FIG. 3, the first and second lights 12, 14 are preferably a pair of flood lamps 12, 14 capable of insertion respectively in light holder sockets 24 (only one being shown in FIG. 3) supported by a housing 26 and capable of mounting the lamps 12, 14 in an electrically connected relation. Also, a circular interface element 28, commonly referred to as a winker button, is removably installed in the respective one of the sockets 24 mounting the second lamp 14, in a position between the socket 24 and threaded end 14A of the second lamp 14. The function of the circular interface element 28 is to cause making and breaking of the parallel portion 20A of the circuit arrangement 20 serially connected to the second lamp 14 and interface element 28 in order to make the second lamp 14 flash on and off.

In accordance with the present invention, the first and second lamps 12, 14 are thusly constructed or configured to provide respective illuminations that are different from one another. Preferably, the first lamp 12 is configured to provide a constant illumination, while the second lamp 14 is configured inherently or by the winker interface element 28 to provide a flashing illumination. In addition, the first and second lamps 12, 14 are configured to respectively provide different colors of illumination. Preferably, the first lamp 12 provides illumination having a substantially white color, while the second lamp 14 provides illumination having a substantially red color. It should be understood that other colors can be employed. As examples, the first lamp 12 can be a 150-watt white constant flood lamp and the second lamp 14 can be a 60-watt flashing red flood lamp.

The electrical power supply providing means 16 of the apparatus 10 is preferably an electrical cord 30 made up of a pair of electrical conductors 30A, 30B and connected at one of their opposite ends to the electrical circuit arrangement 20 which electrically interconnects the motion detector 18 and the first and second lamps 12, 14. The pair of electrical conductors 30A, 30B of the electrical cord 30 have a plug 32 connected at the other of their opposite ends for physically plugging into an electrical outlet socket (not shown) which supplies standard 120 volt, 60 cycle AC. Alternatively, the means 16 can utilize other sources of electricity, such as an AC generator.

The motion detector 18 of the apparatus 10 is connected in electrical series relation with the electrical power supply cord 30 and the first and second lamps 12, 14 by the circuit arrangement 20 of electrical conductors 22. The motion detector 18 is capable of activating the first and second lamps 12, 14 for predetermined times in response to the sensing motion in a protected area being monitored by the motion detector 18. The circuit arrangement 20 also connects the lamps 12, 14 in electrical parallel relation with one another. Thus, in view that the first and second lamps 12, 14 are connected in parallel with one another and in series with the same motion detector 18, the first and second lamps 12, 14 function to respectively provide constant white illumination and flashing red illumination for predetermined time periods which run concurrently with one another. The motion detector 18 can be any suitable commercially-available device which has the motion sensing capability. For instance, a suitable motion detector 18 typically utilizes either ultrasound, infrared, or some other suitable form of energy.

The apparatus 10 also includes a first electrical switch 34 actuatable between on and off positions and interposed in the one conductor 30A of the electrical cord 30 and connected by the circuit arrangement 20 in electrical series relation with the motion detector 18 and the electrical cord 20. The apparatus further includes a signaling device 36 and means 38 for electrically coupling the signaling device 36 to the circuit arrangement 20. One suitable signaling device 36 is an audible .alarm. Other signaling devices can be used in place of, or in 5 addition, to the alarm. The coupling means 38 can be an electrical transformer for stepping down the voltage from 120 VAC to 5 VAC. The transformer 38 transmits the electrical energy so as to activate (turn on and off) the signaling device 36 in correspondence to when the first and second lamps 12, 14 are activated by the motion detector 18. Finally, the apparatus 10 can utilize a second electrical switch 40 actuatable between on and off positions and being connected in electrical series relation with the transformer 38 and the signaling device 36, and an AC interlock 42 being connected in electrical parallel relation with the signaling device 36 for adding a remote buzzer or bell to the circuit arrangement 20.

It is thought that the present invention and its advantages will be understood from the foregoing description and it will be apparent that various changes may be made thereto without departing from its spirit and scope of the invention or sacrificing all of its material advantages, the form hereinbefore described being merely preferred or exemplary embodiment thereof.

Having thus described the invention, what is claimed is:

1. A motion sensing and illumination apparatus comprising:

(a) first means for providing a constant illumination of a first color;

(b) second means for providing a flashing illumination of a second color being different from said first color of said constant illumination;

(c) means for providing a supply of electrical power to activate said first constant illumination providing means and said second flashing illumination providing means;

(d) means for sensing motion in a predetermined area;

(e) means for electrically interconnecting said electrical power supply providing means, said motion sensing means, said first constant illumination providing means, and said second flashing illumination providing means to respectively activate said first constant illumination providing means and said second flashing illumination providing means to provide said respective first constant illumination of said first color and said second flashing illumination of said second color for predetermined time periods which run concurrently with one another in response to sensing of motion in the predetermined area by said motion sensing means, said interconnecting means being a circuit arrangement of electrical conductors connecting said first constant illumination providing means and said second flashing illumination providing means in parallel electrical relation with one another and connecting said motion sensing means in series electrical relation with said electrical power supply providing means and each of said first constant illumination providing means and said second flashing illumination providing means; and (f) an electrical switch actuatable alternately between on and off positions, said circuit arrangement connecting said electrical switch in electrical series relation with said motion sensing means and said electrical power supply providing means.

2. The apparatus of claim 1 wherein said first color is white and said second color is red.

3. The apparatus of claim 1 wherein said electrical power supply providing means is an electrical cord having an outlet plug at one end.

4. The apparatus of claim 1 wherein said signaling device is an audible alarm.

5. A motion sensing and illumination apparatus comprising:

(a) first means for providing a constant illumination of a first color;

(b) second means for providing a flashing illumination of a second color being different from said first color of said constant illumination;

(c) means for providing a supply of electrical power to activate said first constant illumination providing means and said second flashing illumination providing means;

(d) means for sensing motion in a predetermined area;

(e) means for electrically interconnecting said electrical power supply providing means, said motion sensing means, said first constant illumination providing means, and said second flashing illumination providing means to respectively activate said first constant illumination providing means and said second flashing illumination providing means to provide said respective first constant illumination of said first color and said second flashing illumination of said second color for predetermined time periods which run concurrently with one another in response to sensing of motion in the predetermined area by said motion sensing means;

(f) a signaling device;

(g) means for electrically coupling said signaling device to said interconnecting means so as to activate said signaling device when said first constant illumination providing means and said second flashing illumination providing means are activated by said motion sensing means, said coupling means being an electrical transformer; and (h) an electrical switch actuatable alternately between on and off positions and being connected in electrical series relation with said transformer and said signaling device.

6. The apparatus of claim 5 wherein:

said first constant illumination providing means is a first lamp; and said second flashing illumination providing means is a second lamp.

7. The apparatus of claim 6 wherein said interconnecting means includes a circuit arrangement of electrical conductors connecting said first and second lamps in parallel electrical relation with one another and connecting said motion sensing means in electrical series relation with said electrical power supply providing means and each of said first and second lamps.

8. The apparatus of claim 6 wherein said interconnecting means includes:

a pair of sockets for respectively receiving said first and second lamps; and an interface element installed in said socket of said second lamp for electrically contacting said second lamp for causing on and off flashing of said second lamp.

* * * * *